US008678239B2

(12) United States Patent
Abdelmoteleb et al.

(10) Patent No.: US 8,678,239 B2
(45) Date of Patent: Mar. 25, 2014

(54) CLEAN IN PLACE SYSTEM FOR BEVERAGE DISPENSERS

(75) Inventors: Ashraf Farid Abdelmoteleb, Ferntree Gully (AU); Michael Isaac Joffe, Richmond (AU); Edwin Petrus Elisabeth van Opstal, Langwarrin (AU); Mark Andrew Wilcock, Parkdale (AU); Arthur G. Rudick, Atlanta, GA (US); Paul A. Phillips, Marietta, GA (US)

(73) Assignee: The Coca-Cola Company, Atlanta, GA (US)

( * ) Notice: Subject to any disclaimer, the term of this patent is extended or adjusted under 35 U.S.C. 154(b) by 1645 days.

(21) Appl. No.: 11/777,314

(22) Filed: Jul. 13, 2007

(65) Prior Publication Data

US 2009/0014464 A1 Jan. 15, 2009

(51) Int. Cl.
*B67D 1/07* (2006.01)

(52) U.S. Cl.
USPC ..... 222/148; 222/1; 222/145.2; 222/145.4

(58) Field of Classification Search
USPC ..... 222/1, 145.2, 145.4, 148, 149, 151; 141/90, 91, 89; 239/104, 110, 112; 137/238
See application file for complete search history.

(56) References Cited

U.S. PATENT DOCUMENTS

| | | | | |
|---|---|---|---|---|
| 4,053,003 | A | 10/1977 | Ferrero et al. | |
| 4,465,210 | A | 8/1984 | Iwanami | |
| 4,821,925 | A | 4/1989 | Wiley et al. | |
| 5,058,630 | A | 10/1991 | Wiley et al. | |
| 5,558,249 | A | 9/1996 | Falcoff | |
| 6,267,157 | B1 * | 7/2001 | Gruson et al. | 141/90 |
| 6,457,497 | B1 * | 10/2002 | Adriansens et al. | 141/91 |
| 6,761,191 | B2 | 7/2004 | Rosen et al. | |
| 6,907,741 | B2 | 6/2005 | Kateman | |
| 6,941,858 | B2 | 9/2005 | Kateman | |
| 7,261,131 | B2 * | 8/2007 | Cleveland et al. | 141/192 |
| 7,325,485 | B2 | 2/2008 | Carhuff et al. | |
| 7,347,345 | B2 | 3/2008 | Guerrero et al. | |
| 7,640,755 | B1 | 1/2010 | Kateman | |
| 2005/0034779 | A1 | 2/2005 | Berhard | |
| 2005/0236429 | A1 | 10/2005 | Duck et al. | |
| 2006/0213928 | A1 | 9/2006 | Ufheil et al. | |
| 2007/0205220 | A1 | 9/2007 | Rudick et al. | |

FOREIGN PATENT DOCUMENTS

| | | | |
|---|---|---|---|
| DE | 20-2006-006149 | U1 | 6/2007 |
| EP | 0785134 | | 7/1997 |
| EP | 1688388 | | 8/2006 |
| FR | 2615845 | | 12/1988 |
| WO | 88/09766 | A1 | 12/1988 |
| WO | 2005/070816 | A1 | 8/2005 |
| WO | 2005/102906 | A1 | 11/2005 |
| WO | 2007/127525 | | 11/2007 |

* cited by examiner

*Primary Examiner* — J. Casimer Jacyna
(74) *Attorney, Agent, or Firm* — Sutherland Asbill & Brennan LLP

(57) ABSTRACT

A flush system for a dispenser nozzle may include a flush diverter and a carrier. The flush diverter may include a dispense position and a flush position. The carrier maneuvers the flush diverter to either the dispense position or the flush position with respect to the beverage dispenser nozzle.

12 Claims, 13 Drawing Sheets

CLEAN IN PLACE SYSTEM FOR BEVERAGE DISPENSERS

TECHNICAL FIELD

The present application relates generally to a beverage dispenser and more particularly relates to a juice dispenser or any other type of beverage dispenser that is capable of dispensing a number of beverage alternatives on demand.

BACKGROUND OF THE INVENTION

Commonly owned U.S. Pat. No. 4,753,370 concerns a "Tri-Mix Sugar Based Dispensing System." This patent describes a beverage dispensing system that separates the highly concentrated flavoring from the sweetener and the diluent. This separation allows for the creation of numerous beverage options using several flavor modules and one universal sweetener. One of the objectives of the patent is to allow a beverage dispenser to provide as many beverages as may be available on the market in prepackaged bottles or cans. U.S. Pat. No. 4,753,370 is incorporated herein by reference.

These separation techniques, however, generally have not been applied to juice dispensers. Rather, juice dispensers typically have a one (1) to one (1) correspondence between the juice concentrate stored in the dispenser and the products dispensed therefrom. As such, consumers generally can only choose from a relatively small number of products given the necessity for significant storage space for the concentrate. A conventional juice dispenser thus requires a large footprint in order to offer a wide range of different products.

Another issue with known juice dispensers is that the last mouthful of juice in the cup may not be mixed properly such that a large slug of undiluted concentrate may remain. This problem may be caused by insufficient agitation of the viscous juice concentrate. The result often is an unpleasant taste and an unsatisfactory beverage.

Thus, there is a desire for an improved beverage dispenser that can accommodate a wide range of different beverages. Preferably, the beverage dispenser can offer a wide range of juice-based products or other types of beverages within a footprint of a reasonable size. Further, the beverages offered by the beverage dispenser should be properly mixed throughout.

SUMMARY OF THE INVENTION

The present application thus describes a flush system for a dispenser nozzle. The flush system may include a flush diverter and a carrier. The flush diverter may include a dispense position and a flush position. The carrier maneuvers the flush diverter to either the dispense position or the flush position with respect to the dispenser nozzle.

The flush diverter may include a dispense path and a flush path therein. The flush diverter may include a drain pan in communication with a drain. The dispense path may include a dispense path aperture therein. The dispense path aperture may include angled edges. The carrier may include a carrier aperture therein. The flush diverter may include a divider between the dispense path and the flush path. The flush system further may include a motor in communication with the carrier. The carrier may include a hinge to rotate thereabout.

The present application further describes a method for operating a flush diverter about a dispenser nozzle. The method may include the steps of maneuvering the flush diverter to a dispense position, flowing a first fluid through the dispenser nozzle, maneuvering the flush diverter to a flush position, and flowing a second fluid within the flush diverter to a drain.

The method further may include maneuvering the flush diverter to a clean-in-place position. Maneuvering the flush diverter to a clean-in-place position may include removing the flush diverter. Maneuvering the flush diverter to a clean-in-place position may include maneuvering the flush diverter pivotably. Maneuvering the flush diverter to a dispense position may include maneuvering the flush diverter horizontally. Flowing a first fluid through the dispenser nozzle with the flush diverter in a dispense position may include flowing the first fluid through a flush diverter aperture.

The present application further may describe a clean-in-place system for a dispenser with a nozzle, an ingredient source, an ingredient line, and a pump. The clean-in-place system may include a cleaning fluid source with a cleaning fluid therein, a cleaning manifold, a fluid routing device attachable to the nozzle, and a connector positioned on the ingredient line. The connector may include a dispense position and a clean position such that when the fluid routing device is attached to the nozzle and the connector is in the clean position, the cleaning source may flow the cleaning fluid through the manifold and into the ingredient line.

The fluid routing device may include a removable cap. The fluid routing device may include a fluid routing device dispense position and a fluid routing device clean position. The cleaning fluid may include a base. The clean-in-place system further may include a sanitizing fluid source with a sanitizing fluid therein. The sanitizing fluid may include an acid.

The cleaning manifold may include a heater. The cleaning manifold may include a flow sensor, a temperature sensor, a pressure sensor, a conductivity sensor, and/or a pH sensor. The cleaning manifold may include a vent therein. The clean-in-place system further may include a water source such that the water source is in communication the cleaning manifold. The clean-in-place system further may include a fluid circuit through the nozzle, the fluid routing device, the cleaning manifold, the connector, the ingredient line, and the pump. The connector may include a three way connector.

The present application further may describe a method of cleaning a dispenser having a nozzle, an ingredient source, a water source, an ingredient line, and a pump. The method may include the steps of connecting a clean-in-place system at the nozzle and the ingredient line, circulating a cleaning or a sanitizing fluid through the clean-in-place system, the nozzle, the ingredient line, and the pump, and circulating water from the water source through the clean-in-place system, the nozzle, the ingredient line, and the pump.

The method further may include heating the cleaning or sanitizing fluid. The dispenser may include an ingredient source such that connecting the clean-in-place system at the ingredient line may include disconnecting the ingredient source. The method further may include repeating the method steps therein on a predetermined cycle. The clean-in-place system may include a drain and further may include purging the cleaning or sanitizing fluid to the drain after heating, circulating water from the water source through the clean-in-place system, the nozzle, the ingredient line, and the pump, and purging the water to the drain.

These and other features of the present application will become apparent to one of ordinary skill in the art upon review of the following detailed description when taken in conjunction with the several drawings and the appended claims.

DETAILED DESCRIPTION

Figure 1:
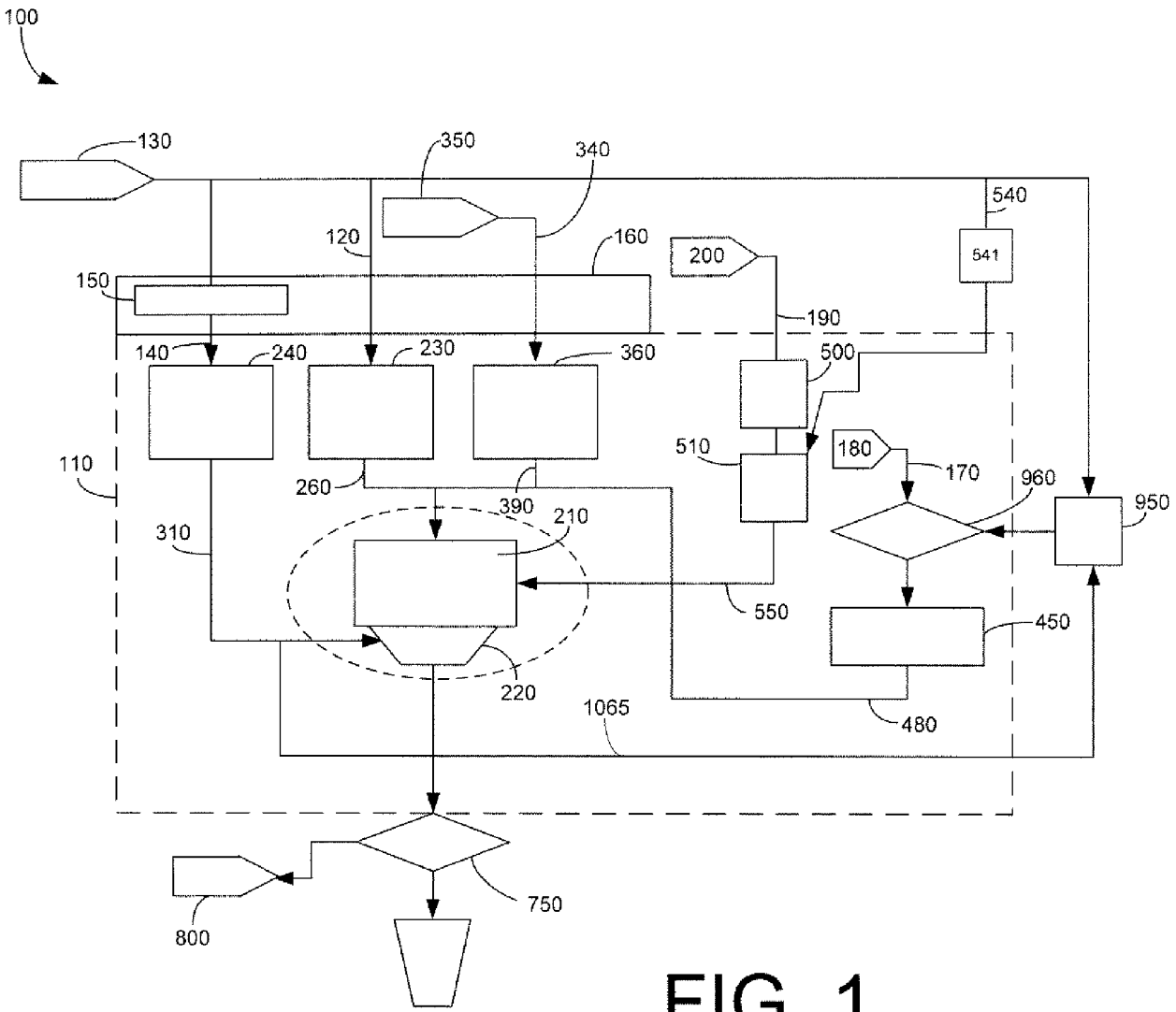
FIG. 1 is a schematic view of a beverage dispenser as is described herein.

Referring now to the drawings, in which like numerals refer to like elements throughout the several views, FIG. 1 shows a schematic view of a beverage dispenser 100 as is described herein. Those portions of the beverage dispenser 100 that may be within a refrigerated compartment 110 are shown within the dashed lines while the non-refrigerated ingredients are shown outside. Other refrigeration configurations may be used herein.

The dispenser 100 may use any number of different ingredients. By way of example, the dispenser 100 may use plain water 120 (still water or noncarbonated water) from a water source 130; carbonated water 140 from a carbonator 150 in communication with the water source 130 (the carbonator 150 and other elements may be positioned within a chiller 160); a number of macro-ingredients 170 from a number of macro-ingredient sources 180; and a number of micro-ingredients 190 from a number of micro-ingredient sources 200. Other types of ingredients may be used herein.

Generally described, the macro-ingredients 170 have reconstitution ratios in the range from full strength (no dilution) to about six (6) to one (1) (but generally less than about ten (10) to one (1)). The macro-ingredients 170 may include juice concentrates, sugar syrup, HECS ("High Fructose Corn Syrup"), concentrated extracts, purees, or similar types of ingredients. Other ingredients may include dairy products, soy, rice concentrates. Similarly, a macro-ingredient base product may include the sweetener as well as flavorings, acids, and other common components. The juice concentrates and dairy products generally require refrigeration. The sugar, HFCS, or other macro-ingredient base products generally may be stored in a conventional bag-in-box container remote from the dispenser 100. The viscosities of the macro-ingredients may range from about one (1) to about 10,000 centipoise and generally over 100 centipoise.

The micro-ingredients 190 may have reconstitution ratios ranging from about ten (10) to one (1) and higher. Specifically, many micro-ingredients 190 may have reconstitution ratios in the range of 50:1 to 300:1 or higher. The viscosities of the micro-ingredients 190 typically range from about one (1) to about six (6) centipoise or so, but may vary from this range. Examples of micro-ingredients 190 include natural or artificial flavors; flavor additives; natural or artificial colors; artificial sweeteners (high potency or otherwise); additives for controlling tartness, e.g., citric acid or potassium citrate; functional additives such as vitamins, minerals, herbal extracts, nutricuticals; and over the counter (or otherwise) medicines such as pseudoephedrine, acetaminophen; and similar types of materials. Various types of alcohols may be used as either micro or macro-ingredients. The micro-ingredients 190 may be in liquid, gaseous, or powder form (and/or combinations thereof including soluble and suspended ingredients in a variety of media, including water, organic solvents and oils). The micro-ingredients 190 may or may not require refrigeration and may be positioned within the dispenser 100 accordingly. Non-beverage substances such as paints, dies, oils, cosmetics, etc. also may be used and dispensed in a similar manner.

The water 120, the carbonated water 140, the macro-ingredients 170 (including the HFCS), and the micro-ingredients 190 may be pumped from their various sources 130, 150, 180, 200 to a mixing module 210 and a nozzle 220 as will be described in more detail below. Each of the ingredients generally must be provided to the mixing module 210 in the correct ratios and/or amounts.

Figure 2:
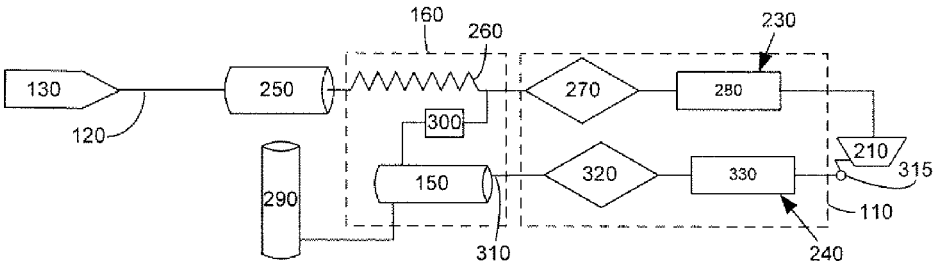
FIG. 2 is a schematic view of a water metering system and a carbonated water metering system as may be used in the beverage dispenser of FIG. 1.

The water 140 may be delivered from the water source 130 to the mixing nozzle 210 via a water metering system 230 while the carbonated water 140 is delivered from the carbonator 150 to the nozzle 220 via a carbonated water metering system 240. As is shown in FIG. 2, the water 120 from the water source 130 may first pass through a pressure regulator 250. The pressure regulator 250 may be of conventional design. The water 120 from the water source 130 will be regulated or boosted to a suitable pressure via the pressure regulator 250, The water then passes through the chiller 160. The chiller 160 may be a mechanically refrigerated water bath with an ice bank therein. A water line 260 passes through the chiller 160 so as to chill the water to the desired temperature. Other chilling methods and devices may be used herein.

The water then flows to the water metering system 230. The water metering system 230 includes a flow meter 270 and a proportional control valve 280. The flow meter 270 provides feedback to the proportional control valve 280 and also may detect a no flow condition. The flow meter 270 may be a paddle wheel device, a turbine device, a gear meter, or any type of conventional metering device. The flow meter 270 may be accurate to within about 2.5 percent or so. A flow rate of about 88.5 milliliters per second may be used although any other flow rates may be used herein. The pressure drop across the chiller 160, the flow meter 270, and the proportional control valve 280 should be relatively low so as to maintain the desired flow rate.

The proportional control valve 280 ensures that the correct ratio of the water 120 to the carbonated water 140 is provided to the mixing module 210 and the nozzle 220 and/or to ensure that the correct flow rate is provided to the mixing module 210 and the nozzle 220. The proportional control valve may operate via pulse width modulation, a variable orifice, or other conventional types of control means. The proportional control valve 280 should be positioned physically close to the mixing nozzle 210 so as to maintain an accurate ratio.

Likewise, the carbonator 150 may be connected to a gas cylinder 290. The gas cylinder 290 generally includes pressurized carbon dioxide or similar gases. The water 120 within the chiller 160 may be pumped to the carbonator 150 by a water pump 300. The water pump 300 may be of conventional design and may include a vane pump and similar types of designs. The water 120 is carbonated by conventional means to become the carbonated water 140. The water 120 may be chilled prior to entry into the carbonator 150 for optimum carbonization.

The carbonated water 140 then may pass into the carbonated water metering system 240 via a carbonated waterline 310. A valve 315 on the carbonated waterline 310 may turn the flow of carbonated water on and off. The carbonated water metering system 240 may also include a flow meter 320 and a proportional control valve 330. The carbonated water flow meter 320 may be similar to the plain water flow meter 270 described above. Likewise, the respective proportional control valves 280, 330 may be similar. The proportional control valve 280 and the flow meter 270 may be integrated in a single unit. Likewise, the proportional control valve 330 and the flow meter 320 may be integrated in a single unit. The proportional control valve 330 also should be located as closely as possible to the nozzle 220. This positioning may minimize the amount of carbonated water in the carbonated waterline 310 and likewise limit the opportunity for carbonation breakout. Bubbles created because of carbonation loss may displace the water in the line 310 and force the water into the nozzle 220 so as to promote dripping.

Figure 3A:
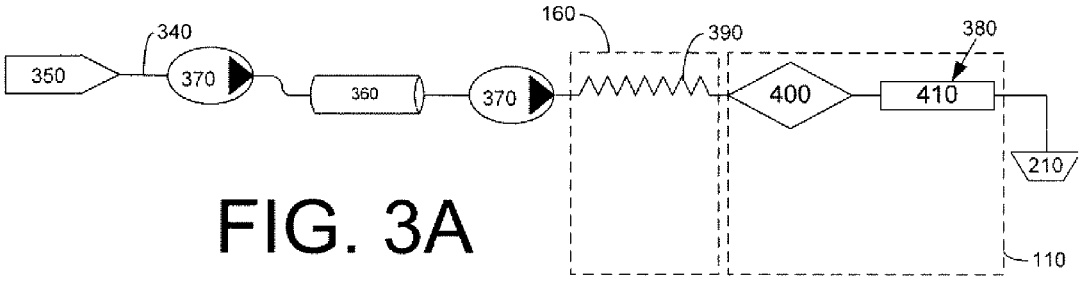
FIG. 3A is a schematic view of a HFCS metering system as may be used in the beverage dispenser of FIG. 1.

One of the macro-ingredients 170 described above includes High Fructose Corn Syrup ("HFCS") 340. The HFCS 340 may be delivered to the mixing module 210 from an HFCS source 350. As is shown in FIG. 3, the HFCS source 350 may be a conventional bag-in-box container or a similar type of container. The HFCS is pumped from the HFCS source 350 via a pump 370. The pump 370 may be a gas assisted pump or a similar type of conventional pumping device. The HFCS source 350 may be located within the dispenser 100 or at a distance from the dispenser 100 as a whole. In the event that a further bag-in-box pump 370 is required, a vacuum regulator 360 may be used to ensure that the inlet of the further bag-in-box pump 370 is not overpressurized. The further bag-in-box pump 370 also may be positioned closer to the chiller 160 depending upon the distance of the HFCS source 350 from the chiller 160. A HFCS line 390 may pass through the chiller 160 such that the HFCS 340 is chilled to the desired temperature.

The HFCS 340 then may pass through a HFCS metering system 380. The HFCS metering system 380 may include a flow meter 400 and a proportional control valve 410. The flow meter 400 may be a conventional flow meter as described above or that described in commonly owned U.S. patent application Ser. No. 11/777,303, entitled "FLOW SENSOR" and filed herewith. U.S. patent application Ser. No. 11/777,303 is incorporated herein by reference. The flow meter 400 and the proportional control valve 410 ensure that the HFCS 340 is delivered to the mixing module 210 at about the desired flow rate and also to detect no flow conditions.

Figure 3B:
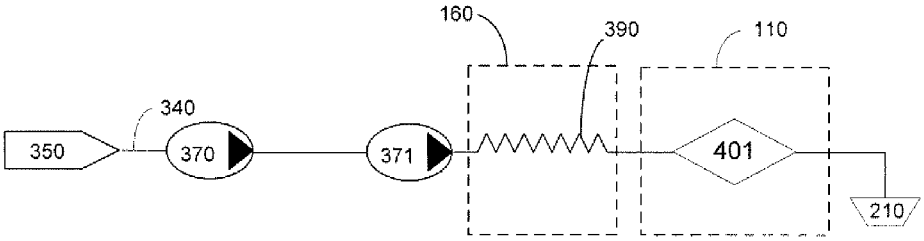
FIG. 3B is a schematic view of an alternative HFCS metering system as may be used in the beverage dispenser of FIG. 1.

FIG. 3B shows an alternate method of HFCS delivery. The HFCS 340 may be pumped from the HFCS source 350 by the bag-in-box pump 370 located close to the HFCS source 350. A second pump 371 may be located close to or inside of the dispenser 100. The second pump 371 may be a positive displacement pump such as a progressive cavity pump. The second pump 371 pumps the HFCS 340 at a precise flow rate through the HFCS line 390 and through the chiller 160 such that the HFCS 340 is chilled to the desired temperature. The HFCS 340 then may pass through an HFCS flow meter 401 similar to that described above. The flow meter 401 and the positive displacement pump 371 ensure that the HFCS 340 is delivered to the mixing module 210 at about the desired flow rate and also detects no flow conditions. If the positive displacement pump 371 can provide a sufficient level of flow rate accuracy without feedback from the flow meter 401, then the system as a whole can be run in an "open loop" manner.

Figure 4A:
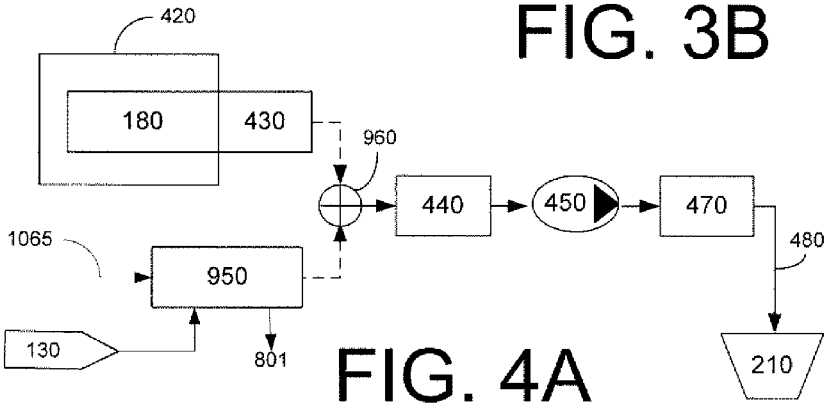
FIG. 4A is a schematic view of a macro-ingredient storage and metering system as may be used in the beverage dispenser of FIG. 1.

Although FIG. 1 shows only a single macro-ingredient source 180, the dispenser 100 may include any number of macro-ingredient 170 and macro-ingredient sources 180. In this example, eight (8) macro-ingredient sources 180 may be used although any number may be used herein. Each macro-ingredient source 180 may be a flexible bag or any conventional type of a container. Each macro-ingredient source 180 may be housed in a macro-ingredient tray 420 or in a similar mechanism or container. Although the macro-ingredient tray 420 will be described in more detail below, FIG. 4A shows the macro-ingredient tray 420 housing a macro-ingredient source 180 having a female fitting 430 so as to mate with a male fitting 440 associated with a macro-ingredient pump 450 via a CIP connector. (The CIP connector 960 as will be described in more detail below). Other types of connection means may be used herein. The macro-ingredient tray 420 and the CIP connector thus can disconnect the macro-ingredient sources 180 from the macro-ingredient pumps 450 for cleaning or replacement. The macro-ingredient tray 420 also may be removable.

The macro-ingredient pump 450 may be a progressive cavity pump, a flexible impeller pump, a peristaltic pump, other types of positive displacement pumps, or similar types of devices. The macro-ingredient pump 450 may be able to pump a range of macro-ingredients 170 at a flow rate of about one (1) to about sixty (60) milliliters per second or so with an accuracy of about 2.5 percent. The flow rate may vary from about five percent (5%) to one hundred percent (100%) flow rate. Other flow rates may be used herein. The macro-ingredient pump 450 may be calibrated for the characteristics of a particular type of macro-ingredient 170. The fittings 430, 440 also may be dedicated to a particular type of macro-ingredient 170.

Figure 4B:
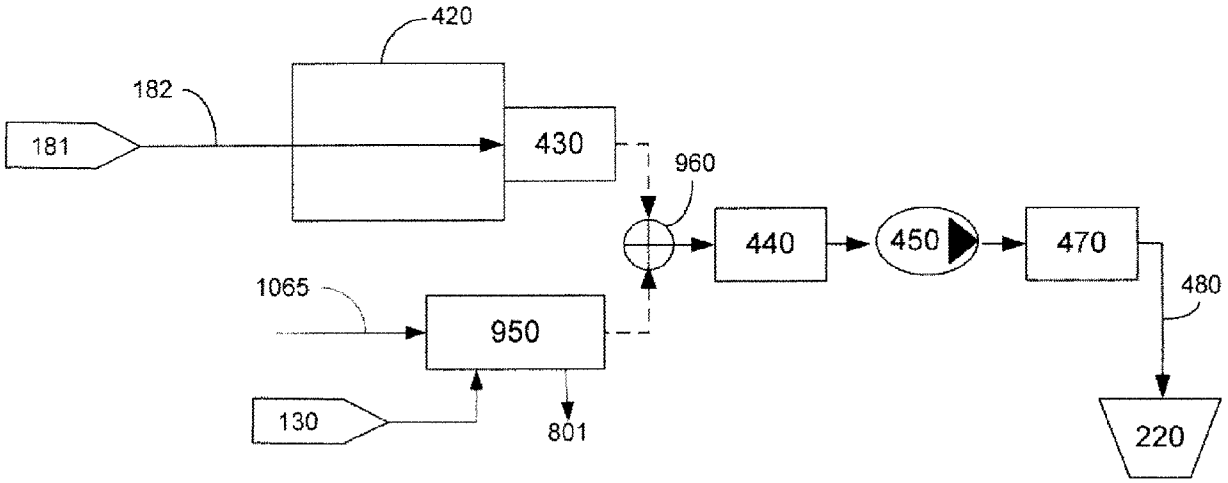
FIG. 4B is a schematic view of a macro-ingredient storage and metering system as may be used in the beverage dispenser of FIG. 1.

A flow sensor 470 may be in communication with the pump 450. The flow sensor 470 may be similar to those described above. The flow sensor 470 ensures the correct flow rate therethrough and detects no flow conditions. A macro-ingredient line 480 may connect the pump 450 and the flow sensor 470 with the mixing module 210. As described above, the system can be operated in a "closed loop" manner in which case the flow sensor 470 measures the macro-ingredient flow rate and provide feedback to the pump 450. If the positive displacement pump 450 can provide a sufficient level of flow rate accuracy without feedback from the flow sensor 470, then the system can be run in an "open loop" manner. Alternatively, a remotely located macro-ingredient source 181 may be connected to the female fitting 430 via a tube 182 as shown in FIG. 4B. The remotely located macro-ingredient source 181 may be located outside of the dispenser 100.

The dispenser 100 also may include any number of micro-ingredients 190. In this example, thirty-two (32) micro-ingredient sources 200 may be used although any number may used herein. The micro-ingredient sources 200 may be positioned within a plastic or a cardboard box to facilitate handling, storage, and loading. Each micro-ingredient source 200 may be in communication with a micro-ingredient pump 500. The micro-ingredient pump 500 may be a positive-displacement pump so as to provide accurately very small doses of the micro-ingredients 190. Similar types of devices may be used herein such as peristaltic pumps, solenoid pumps, piezoelectric pumps, and the like.

Figure 5:
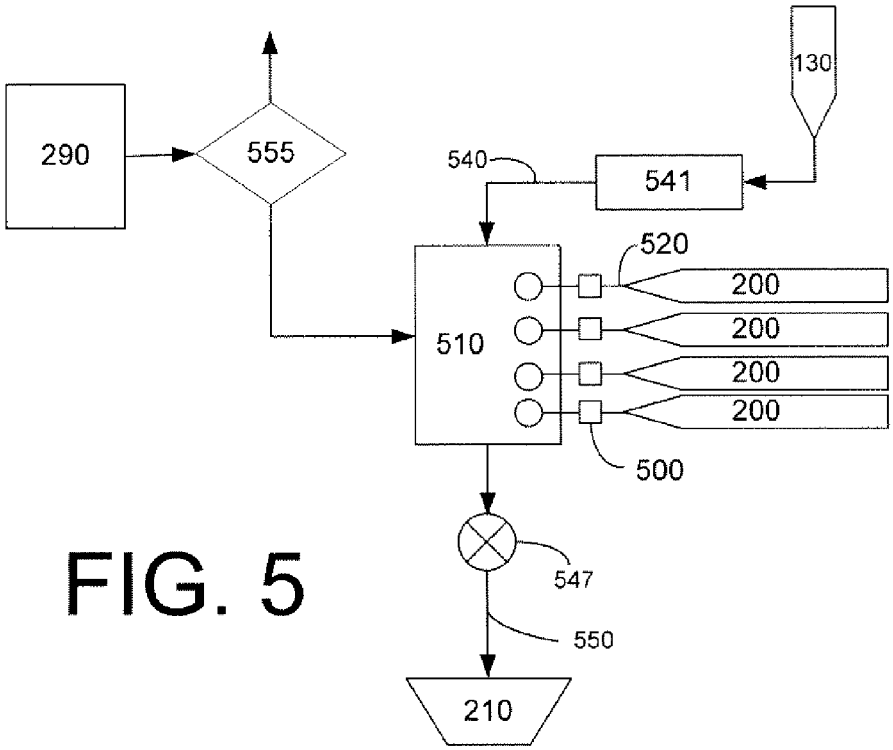
FIG. 5 is a schematic view of a micro-ingredient mixing chamber as may be used in the beverage dispenser of FIG. 1.
Figure 6:
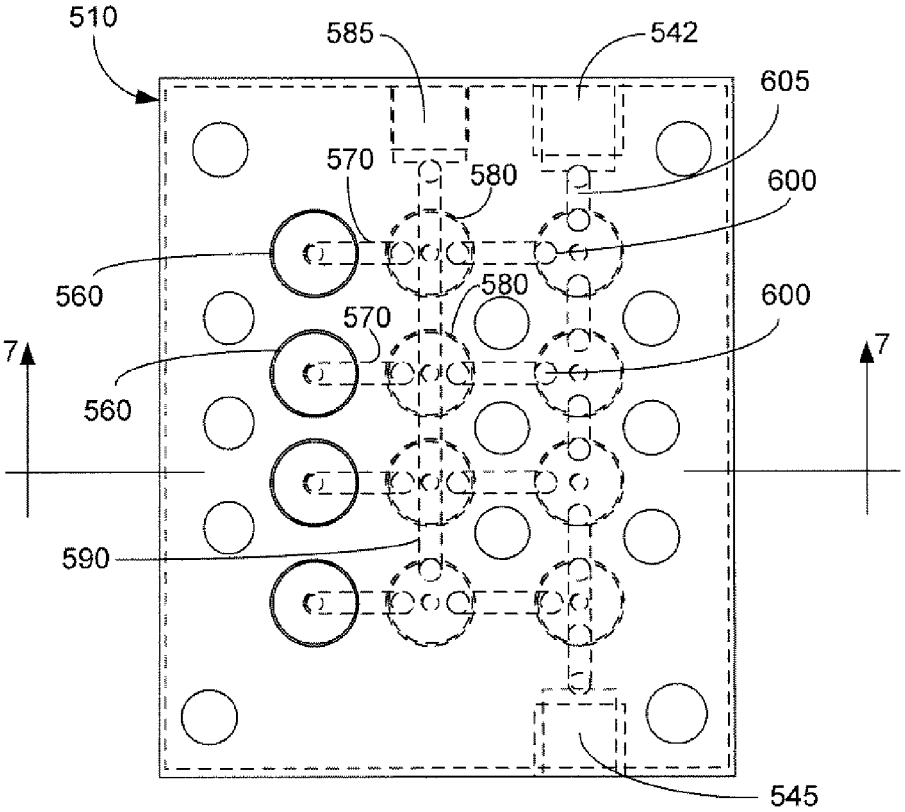
FIG. 6 is a front view of the micro-ingredient mixing chamber of FIG. 5.
Figure 7:
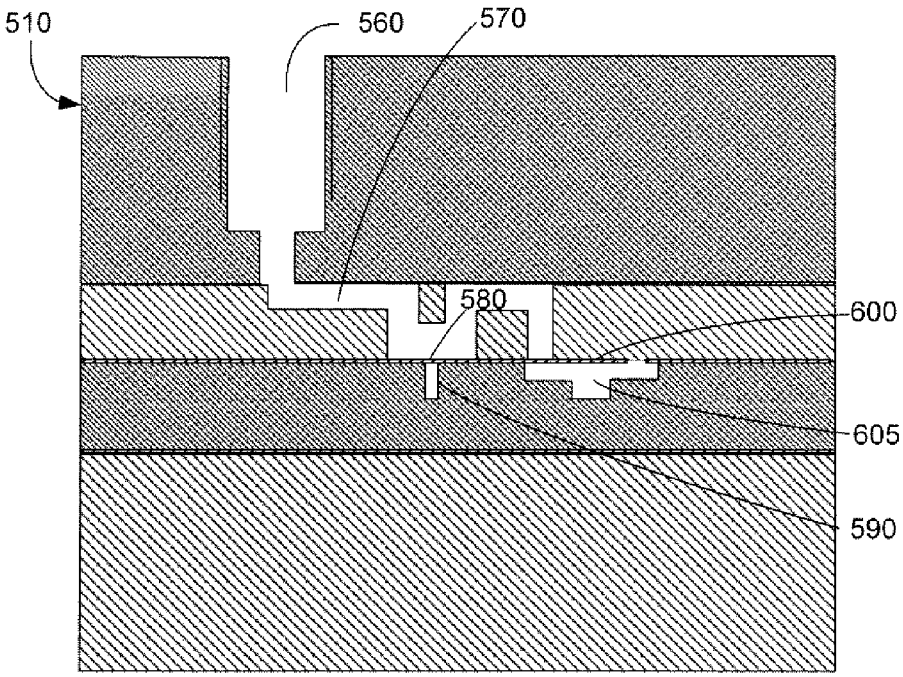
FIG. 7 is a cross-sectional view of the micro-ingredient mixing chamber taken along line 7-7 of FIG. 6.

Each micro-ingredient source 200 may be in communication with a micro-ingredient mixing chamber 510 via a micro-ingredient line 520. Use of the micro-ingredient mixing chamber 510 is shown in FIG. 5. The micro-ingredient mixing chamber 510 may be in communication with an auxiliary waterline 540 that directs a small amount of water 120 from the water source 130. The water 120 flows from the source 130 into the auxiliary waterline 540 through a pressure regulator 541 where the pressure may be reduced to approximately 10 psi or so. Other pressures may be used herein. The water 120 continues through the waterline 540 to a water inlet port 542 and then continues through a central water channel 605 that runs through the micro-ingredient mixing chamber 510. Each of the micro-ingredients 190 is mixed with water 120 within the central water chamber 605 of the micro-ingredient mixing chamber 510. The mixture of water and micro-ingredients exits the micro-ingredient mixing chamber 510 via an exit port 545 and is sent to the mixing module 210 via a combined micro-ingredient line 550 and an on/off valve 547. The micro-ingredient mixing chamber 510 also may be in communication with the carbon dioxide gas cylinder 290 via a three-way valve 555 and a pneumatic inlet port 585 so as to pressurize and depressurize the micro-ingredient mixing chamber 510 as will be described in more detail below.

As is shown in FIGS. 6-9, the micro-ingredient mixing chamber 510 may be a multilayer micro-fluidic device. Each micro-ingredient line 520 may be in communication with the micro-ingredient mixing chamber 510 via an inlet port fitting 560 that leads to an ingredient channel 570. The ingredient channel 570 may have a displacement membrane 580 in communication with the pneumatic channel 590 and a one-way membrane valve 600 leading to a central water channel 605 and the combined micro-ingredient line 550. The displacement membrane 580 may be made out of an elastomeric membrane. The membrane 580 may act as a backpressure reduction device in that it may reduce the pressure on the one-way membrane valve 600. Backpressure on the one-way membrane valve 600 may cause leaking of the micro-ingredients 190 through the valve 600. The one-way membrane valve 600 generally remains closed unless micro-ingredients 190 are flowing through the ingredient channel 570 in the preferred direction. All of the displacement membranes 580 and one-way membrane valves 600 may be made from one common membrane.

Figure 8:
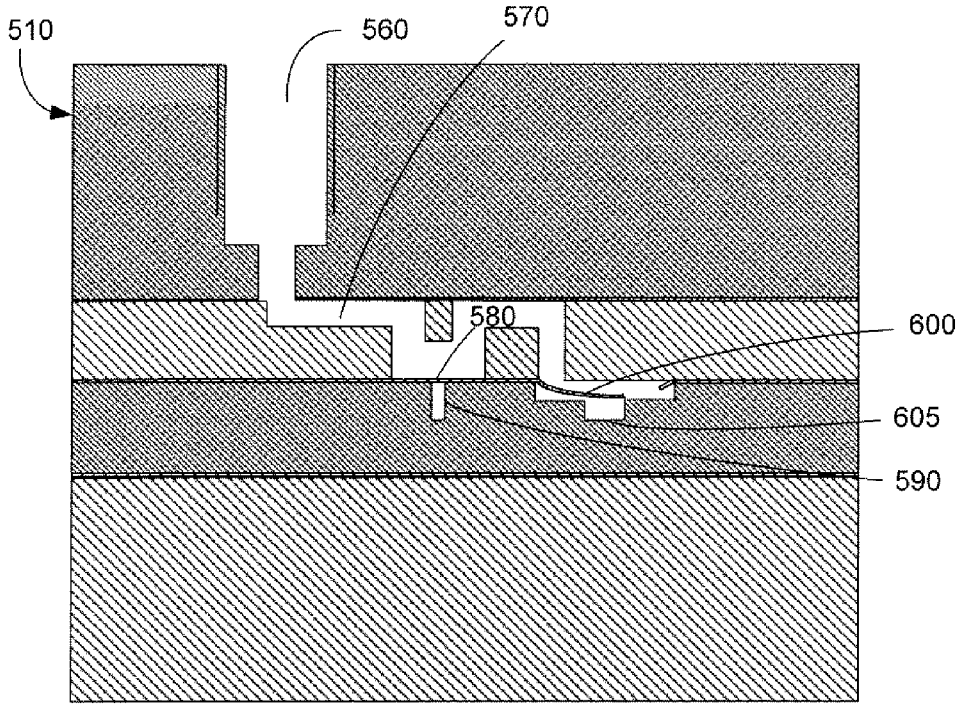
FIG. 8 is a cross-sectional view of the micro-ingredient mixing chamber taken along line 7-7 of FIG. 6.

At the start of a dispense, the on/off valve 547 opens and the water 120 may begin to flow into the micro-mixing chamber 510 at a low flow rate but with high linear velocity. For example, the flow rate may be about one (1) milliliter per second. Other flow rates may be used herein. The micro-ingredient pumps 500 then may begin pumping the desired micro-ingredients 190. As is shown in FIG. 8, the pumping action opens the one-way membrane valve 600 and the ingredients 190 are dispensed into the central water channel 605. The micro-ingredients 190 together with the water 120 flow to the mixing module 210 where they may be combined to produce a final product.

Figure 9:
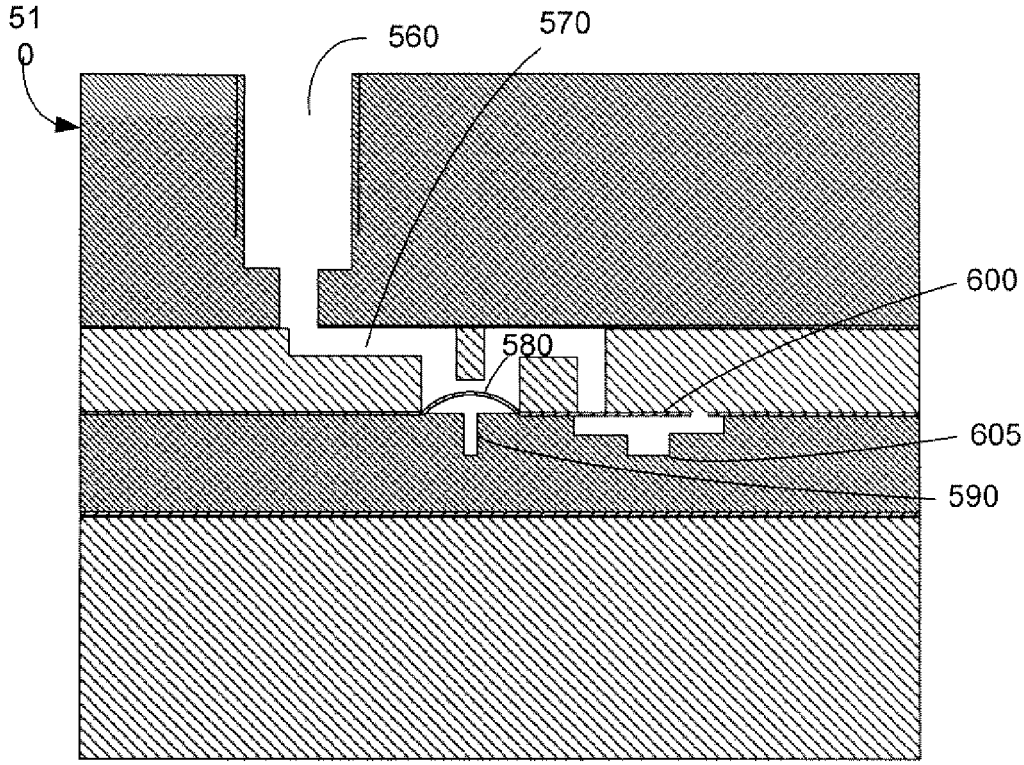
FIG. 9 is a cross-sectional view of the micro-ingredient mixing chamber taken along line 7-7 of FIG. 6.
Figure 10A:
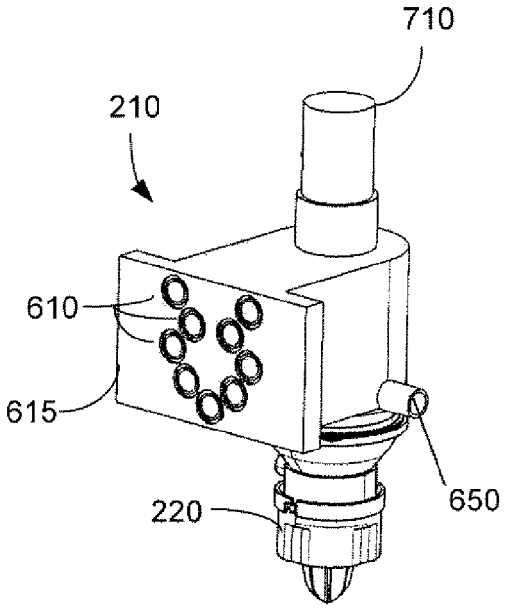
FIG. 10A is a perspective view of the mixing module as may be used in the beverage dispenser of FIG. 1.
Figure 10B:
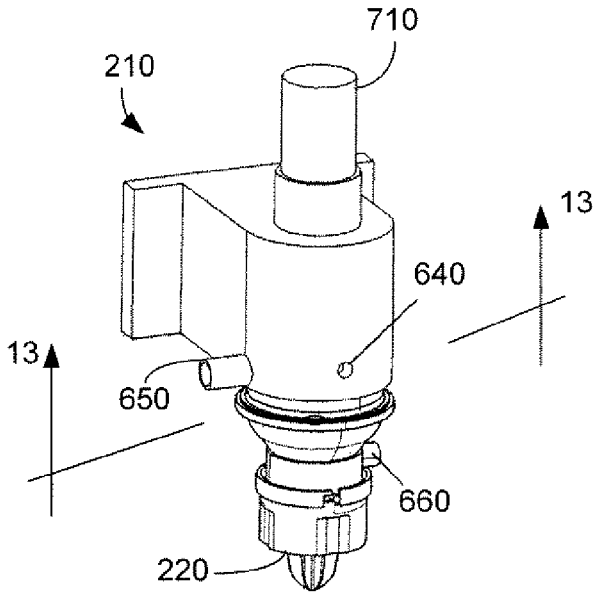
FIG. 10B is a further perspective view of the mixing module of FIG. 10A.
Figure 10C:
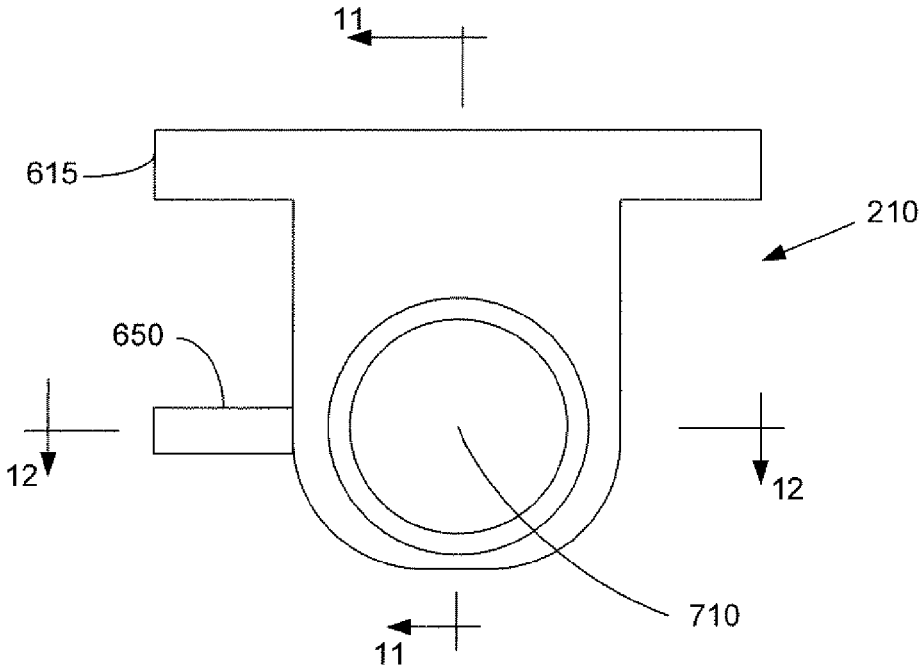
FIG. 10C is a top view of the mixing module of FIG. 10A.
Figure 11:
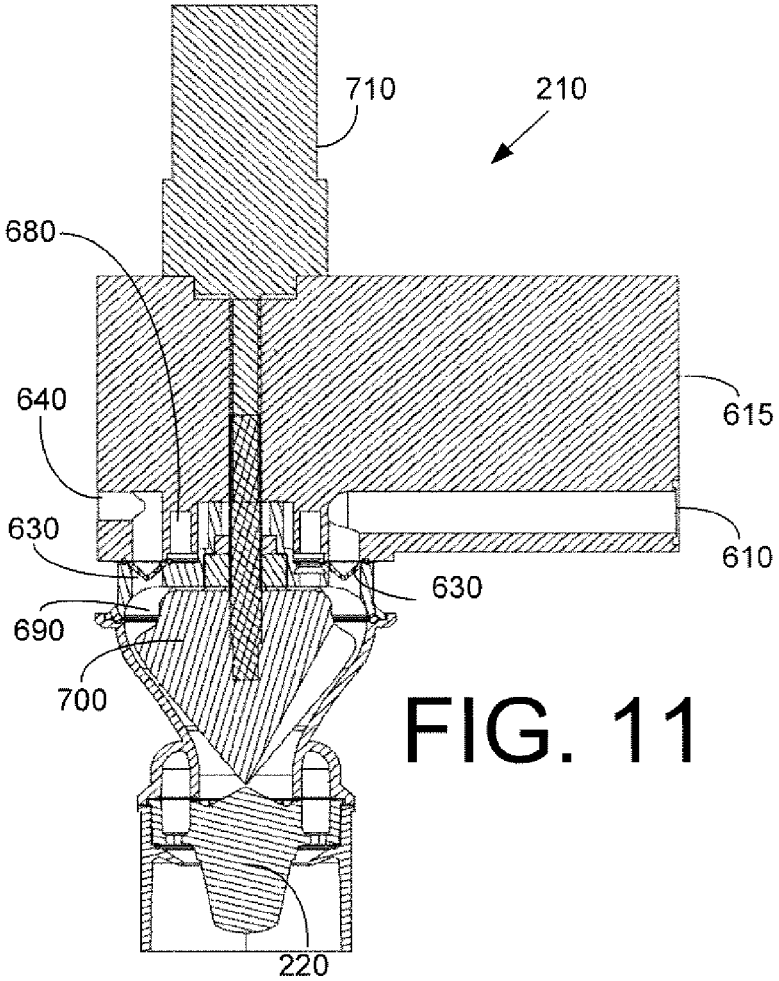
FIG. 11 is a side cross-sectional view of the mixing module taken along line II-II of FIG. 10*c*.
Figure 12:
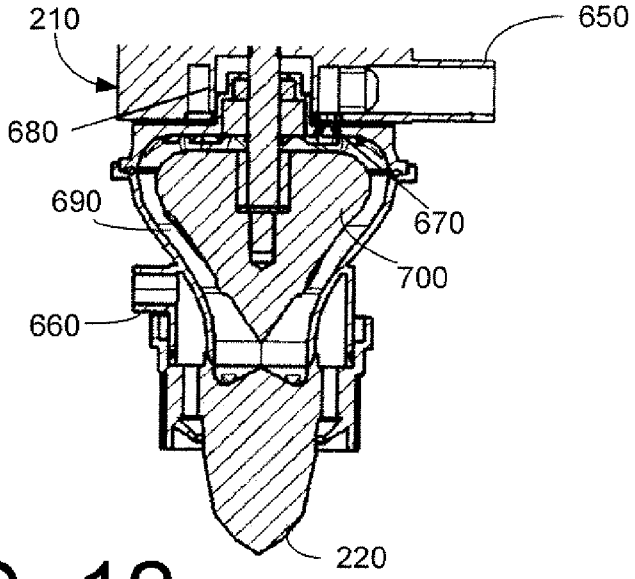
FIG. 12 is a side cross-sectional view of the mixing module taken along line 12-12 of FIG. 10C.
Figure 13:
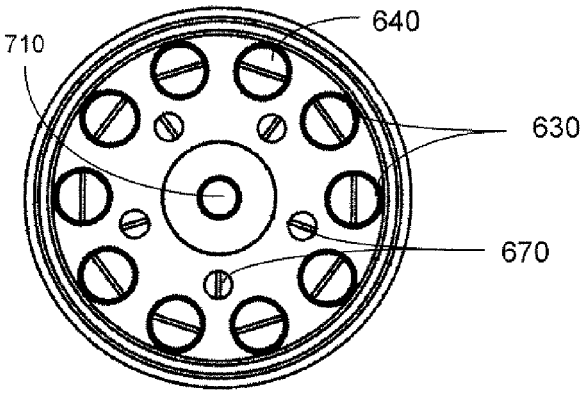
FIG. 13 is a further side cross-sectional view of the mixing module taken along line 13-13 of FIG. 10B.

At the end of the dispense, the micro-ingredient pumps 500 may then stop but the water 120 continues to flow into the micro-ingredient mixer 510. At this time, the pneumatic channel 590 may alternate between a pressurized and a depressurized condition via the three-way valve 555. As is shown in FIG. 9, the membrane 580 deflects when pressurized and displaces any further micro-ingredients 190 from the ingredient channel 570 into the central water channel 605. When depressurized, the membrane 580 returns to its original position and draws a slight vacuum in the ingredient channel 570. The vacuum may ensure that there is no residual backpressure on the one-way membrane valve 600. This helps to ensure that the valve 600 remains closed so as to prevent carryover or micro-ingredient weep therethrough. The flow of water through the micro-ingredient mixer 510 carries the micro-ingredients 190 displaced after the end of the dispense to the combined micro-ingredient line 550 and the mixing module 210.

The micro-ingredients displaced after the end of the dispense then may be diverted to a drain as part of a post-dispense flush cycle (which will be described in detail below). After the post-dispense flush cycle is complete, the valve 547 closes and the central water channel 605 is pressurized according to the setting of the regulator 541. This pressure holds the membrane valve 600 tightly closed.

FIGS. 10A-13 show the mixing module 210 with the nozzle 220 positioned underneath. The mixing module 210 may have a number of macro-ingredient entry ports 610 as part of a macro-ingredient manifold 615. The macro-ingredient entry ports 610 can accommodate the macro-ingredients 170, including the HFCS 340. Nine (9) macro-ingredient entry ports 610 are shown although any number of ports 610 may be used. Each macro-ingredient port 610 may be closed by a duckbill valve 630. Other types of check valves, one way valves, or sealing valves may be used herein. The duckbill valves 630 prevent the backflow of the ingredients 170, 190, 340 and the water 120. Eight (8) of the ports 610 are used for the macro-ingredients and one (1) port is used for the HFCS 340. A micro-ingredient entry port 640, in communication with the combined micro-ingredient line 550, may enter the top of the mixing chamber 690 via a duckbill valve 630.

The mixing module 210 includes a water entry port 650 and a carbonated water entry port 660 positioned about the nozzle 220. The water entry port 650 may include a number of water duckbill valve 670 or a similar type of sealing valve. The water entry port 650 may lead to an annular water chamber 680 that surrounds a mixer shaft (as will be described in more detail below). The annular water chamber 680 is in fluid communication with the top of a mixing chamber 690 via five (5) water duckbill valves 670. The water duckbill valves 670 are positioned about an inner diameter of the chamber wall such that the water 120 exiting the water duckbill valves 670 washes over all of the other ingredient duckbill valves 630. This insures that proper mixing will occur during the dispensing cycle and proper cleaning will occur during the flush cycle. Other types of distribution means may be used herein.

A mixer 700 may be positioned within the mixing chamber 690. The mixer 700 may be an agitator driven by a motor/gear combination 710. The motor/gear combination 710 may include a DC motor, a gear reduction box, or other conventional types of drive means. The mixer 700 rotates at 1a variable speed depending on the nature of the ingredients being mixed, typically in the range of about 500 to about 1500 rpm so as to provide effective mixing. Other speed may be used herein. The mixer 700 may thoroughly combine the ingredients of differing viscosities and amounts to create a homogeneous mixture without excessive foaming. The reduced volume of the mixing chamber 690 provides for a more direct dispense. The diameter of the mixing chamber 690 may be determined by the number of macro-ingredients 170 that may be used. The internal volume of the mixing chamber 690 also is kept to a minimum so as to reduce the loss of ingredients during the flush cycle as will be described in more detail below. The mixing chamber 690 and the mixer 700 may be largely onion-shaped so as to retain fluids therein because of the centrifugal force during the flush cycle when the mixer 700 is running. The mixing chamber 690 thus minimizes the volume of water required for flushing.

Figure 14:
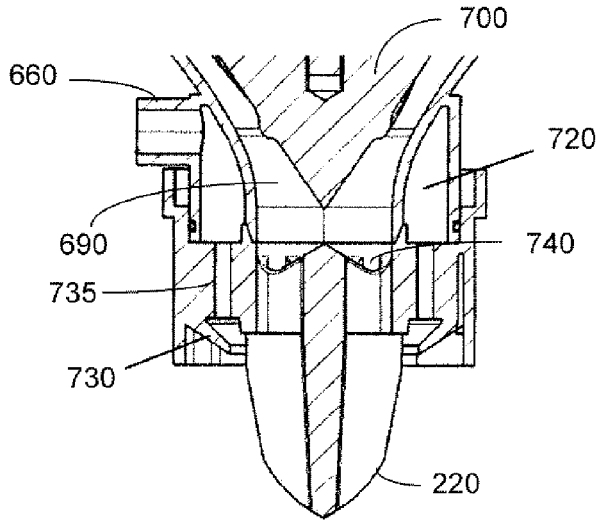
FIG. 14 is an enlargement of the bottom portion of FIG. 12.
Figure 15:
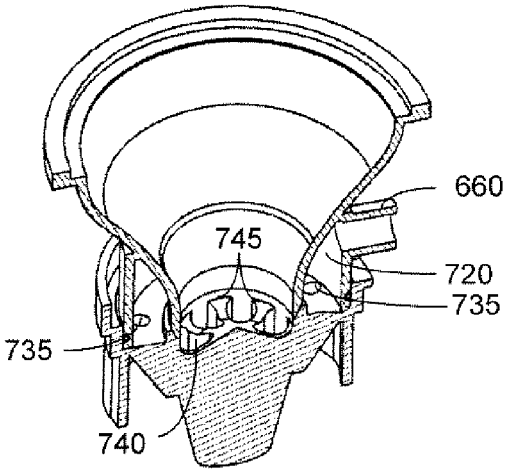
FIG. 15 is a side cross-sectional view of the mixing module and the nozzle of FIG. 14 shown in perspective.
Figure 16:
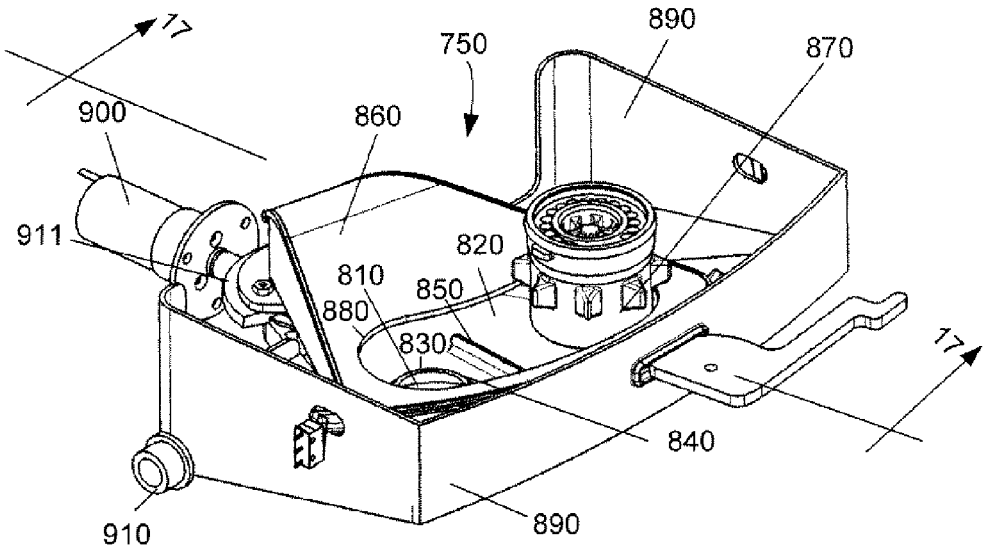
FIG. 16 is a perspective view of a flush diverter as may be used in the beverage dispenser of FIG. 1.

As is shown in FIGS. 14 and 15, the carbonated water entry 660 may lead to an annular carbonated water chamber 720 positioned just above the nozzle 220 and below the mixing chamber 690. The annular carbonated water chamber 720 in turn may lead to a flow deflector 730 via a number of vertical pathways 735. The flow deflector 730 directs the carbonated water flow into the mixed water and ingredient stream so as to promote further mixing. Other types of distribution means may be used herein. The nozzle 220 itself may have a number of exits 740 and baffles 745 positioned therein. The baffles 745 may straighten the flow that may have a rotational component after leaving the mixer 700. The flow along the nozzle 220 should be visually appealing.

The macro-ingredients 170 (including the HFCS 340), the micro-ingredients 190, and the water 140 thus may be mixed in the mixing chamber 690 via the mixer 700. The carbonated water 140 is then sprayed into the mixed ingredient stream via the flow deflector 730. Mixing continues as the stream continues down the nozzle 220.

After the completion of a dispense, pumping the ingredients 120, 140, 170, 190, 340 intended for the final beverage stops and the mixing chamber 690 is flushed with water with the mixer 700 turned on. The mixer 700 may run at about 1500 rpm for about three (3) to about five (5) seconds and may alternate between forward and reverse motion (know as Wig-Wag action) to enhance cleaning. Other speeds and times may be used herein depending upon the nature of the last beverage. About thirty (30) milliliters of water may be used in each flush depending upon the beverage. While the mixer 700 is running, the flush water will remain in the mixing chamber 690 because of centrifugal force. The mixing chamber 690 will drain once the mixer is turned off. The flush thus largely prevents carry over from one beverage to the next.

Figure 19:
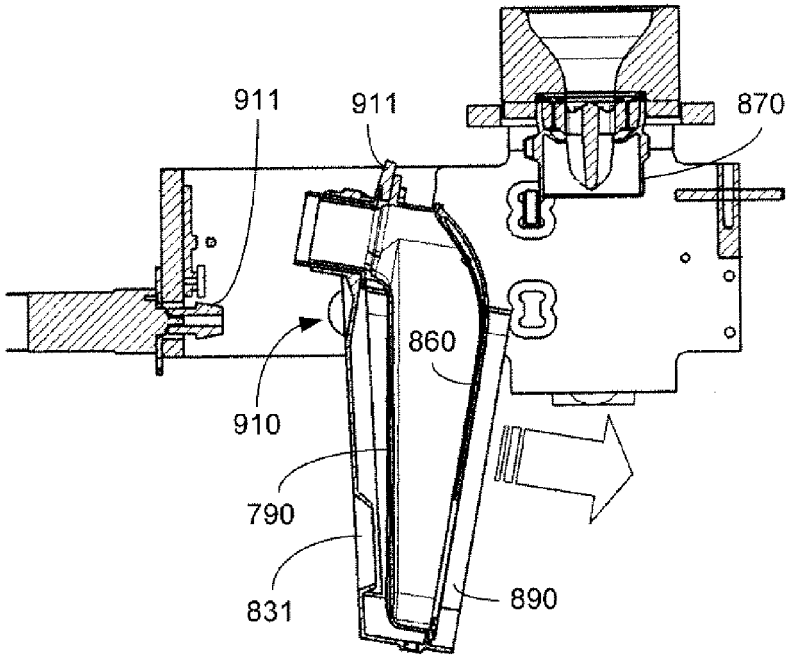
FIG. 19 is a side cross-sectional view of the flush diverter taken along line 17-17 of FIG. 16.
Figure 20:
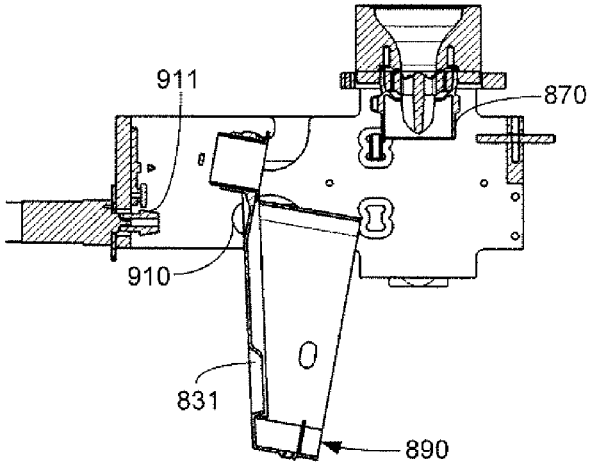
FIG. 20 is a side cross-sectional view of the flush diverter taken along line 17-17 of FIG. 16.
Figure 21A:
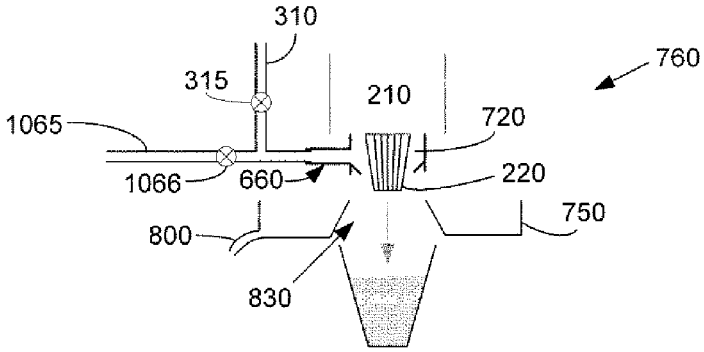
FIGS. 21A-21C are schematic views showing the operation of the flush diverter.
Figure 21B:
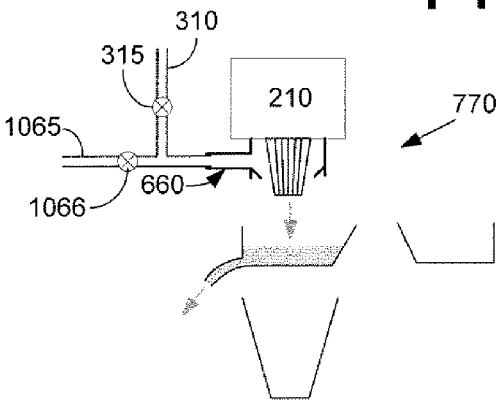
Figure 21C:
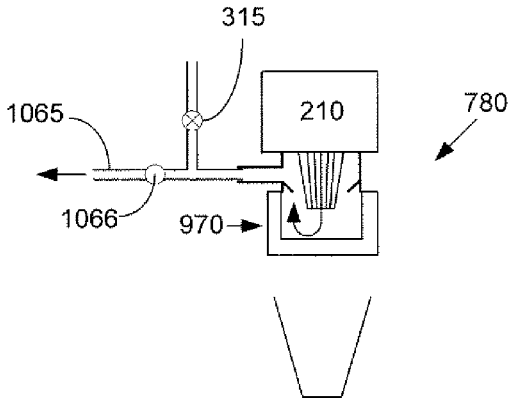

FIGS. 16 through 20 show a flush diverter 750. The flush diverter 750 may be positioned about the nozzle 220. As is schematically shown in FIGS. 21A-21C, the flush diverter 750 may have a dispense mode 760, a flush mode 770, and a clean-in-place mode 780. The flush diverter 750 maneuvers between the dispense mode 760 and the flush mode 770. The flush diverter 750 then may be removed in the clean-in-place mode 780.

The flush diverter 750 may include a drain pan 790 that leads to an external drain 800. The drain pan 790 is angled so as to promote flow towards the drain 800. The drain pan 790 includes a dispense opening 830 positioned therein. The dispense opening 830 has upwardly angled edges 840 so as to mininize spray from the nozzle 220.

The drain pan 790 has a dispensing path 810 and a flush path 820. A divider 850 may separate the dispensing path 810 from the flush path 820. The divider 850 minimizes the chance that some of the flush water may come out of the dispense opening 830. A flush diverter lid 860 may be positioned over the drain pan 790. A nozzle shroud 870 that may be connected to the nozzle 220 may be sized to maneuver within a lid aperture 880 of the lid 860. The nozzle shroud 870 also may minimize any spray from the nozzle 220.

The flush diverter 750 may be positioned on a flush diverter carrier 890. The flush diverter carrier 890 includes a carrier opening 831 that may align with the nozzle 220. The flush diverter 750 may be maneuvered rotationally (pivoting around the vertical axis of the centerline of the drain 800) by a flush diverter motor 900 in connection with a number of gears 911. The flush diverter motor 900 may be a DC gear motor or a similar type of device. The gears 911 may be a set of bevel gears in a rack and pinion configuration or a similar type of device. The flush diverter 750 may rotate within the carrier 890 while the carrier 890 may remain stationary. As shown in FIG. 19, the flush diverter carrier 890 also may be pivotable about a number of hinge points 910 that attach to the frame of the dispenser so as to provide a horizontal axis of the rotation for the carrier 890. In the dispense and flush modes, the carrier 890 may be substantially horizontal. In the clean-in-place mode, the carrier 890 may be substantially vertical. In the dispense and flush modes, the carrier opening 831 is aligned with the nozzle 220.

Figure 17:
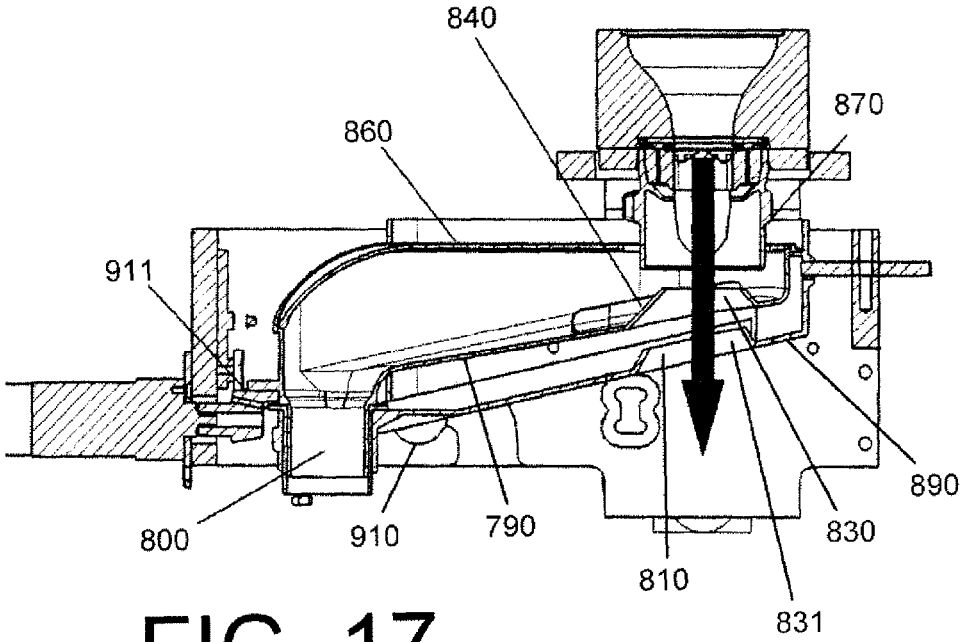
FIG. 17 is a side cross-sectional view of the flush diverter taken along line 17-17 of FIG. 16.
Figure 18:
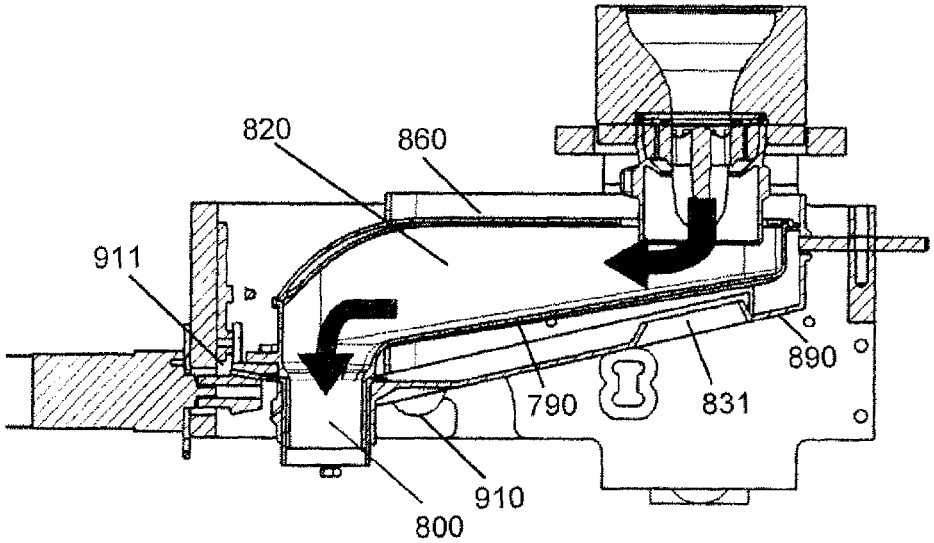
FIG. 18 is a side cross-sectional view of the flush diverter taken along line 17-17 of FIG. 16.

As is shown in FIG. 18, the flush diverter 750 may stay in the flush mode 770 until a dispense begins so as to catch stray drips from the nozzle 220. Once a dispense does begin, the flush diverter 750 moves such that the nozzle 220 with the nozzle shroud 870 aligns with the dispense path 810 and the dispense opening 830 as is shown in FIG. 17. The beverage thus has a clear path out of the flush diverter 750 and the carrier 890. The flush diverter 750 remains in this position for a few second after the dispense to allow the mixing module 210 to drain. The flush diverter 750 then returns to the flush mode 770. Specifically, the nozzle 220 may now be positioned over the flush path 820. The flushing fluid then may passes through the nozzle 220 and through the drain pan 790 to the drain 800 so as to flush the mixing chamber 210 and the nozzle 220 and to minimize any carry over in the next beverage. The drain 800 may be routed such that the flushing fluid is not seen.

In clean-place-mode 780, the flush diverter 750 and the flush diverter carrier 890 may pivot about the hinge point 910 as is shown in FIG. 19. This allows access to the nozzle 220 for cleaning. Likewise, the flush diverter 750 may be removed from the flush diverter carrier 890 for cleaning as shown in FIG. 20

The dispenser 100 also may include a clean-in-place system 950. The clean-in-place system 950 cleans and sanitizes the components of the dispenser 100 on a scheduled basis and/or as desired.

Figure 22:
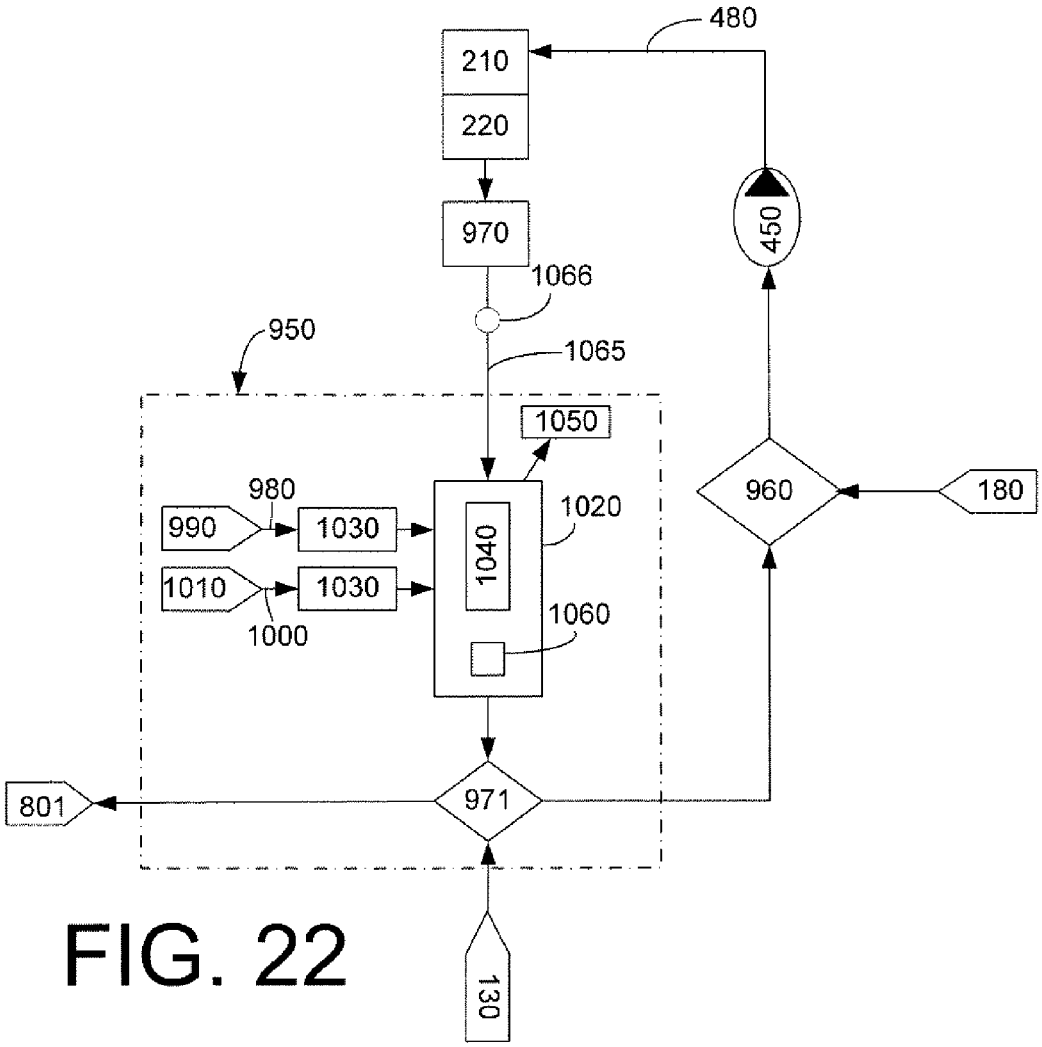
FIG. 22 is a schematic view of a clean-in-place system as may be used in the beverage dispenser of FIG. 1.
Figure 23:
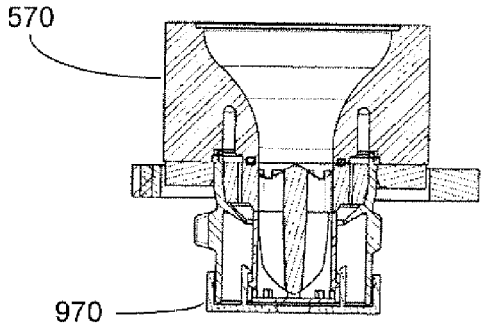
FIG. 23 is a side cross-sectional view of a clean-in-place cap as may be used in the clean-in-place system of FIG. 22.

As is schematically shown in FIG. 22, the clean-in-place system 950 may communicate with the dispenser 100 as a whole via two locations: a clean-in-place connector 960 and a clean-in-place cap 970. The clean-in-place connector 960 may tie into the dispenser 100 near the macro-ingredient sources 180. The clean-in-place connector 960 may function as a three-way valve or a similar type of connection means. The clean-in-place cap 970 may be attached to the nozzle 220 when desired. As is shown in FIG. 23, the clean-in-place cap 970 may be a two-piece structure such that in its closed mode, the clean-in-place cap 970 recirculates cleaning fluid through the nozzle 220 and the dispenser 100. In its open mode, the clean-in-place cap 970 diverts the cleaning fluid from the nozzle 220 so as to drain any remaining fluid away from the cap 970.

The clean-in-place system 950 may use one or more cleaning chemicals 980 positioned within cleaning chemical sources 990. The cleaning chemicals 980 may include hot water, sodium hydroxide, potassium hydroxide, and the like. The cleaning chemical source 990 may include a number of modules to provide safe loading and removal of the cleaning chemicals 980. The modules ensure correct installation and a correct seal with the pumps described below. The clean-in-place system 950 also may include one or more sanitizing chemicals 1000. The sanitizing chemicals 1000 may include phosphoric acid, citric acid, and similar types of chemicals. The sanitizing chemicals 1000 may be positioned within one or more sanitizing chemical sources 1010. The cleaning chemicals 980 and the sanitizing chemicals 1000 may be connected to a clean-in-place manifold 1020 via one or more clean-in-place pumps 1030. The clean-in-place pumps 1030 may be of conventional design and may include a single action piston pump, a peristaltic pump, and similar types of device. The cleaning chemical sources 990 and the sanitizing chemical sources 1010 may have dedicated connections to the clean-in-place manifold 1020.

A heater 1040 may be located inside of the manifold 1020. (Alternatively, the heater 1040 may be located outside the manifold 1020.) The heater 1040 heats the fluid flow as it passes therethrough. The manifold 1020 may have one or more vents 1050 and one or more sensors 1060. The vents 1050 provide pressure relief for the clean-in-place system 950 a whole and also may be used to provide air inlet during drainage. The sensors 1060 ensure that fluid is flowing therethrough and may detect no flow conditions. The sensors 1060 also may monitor temperature, pressure, conductivity, pH, and any other variable. Any variation outside of the expected values may indicate a fault in the dispenser 100 as a whole.

The clean-in-place system 950 therefore provides a circuit from the clean-in-place manifold 1020 (which contains the heater 1040) to the valve manifold 971. The valve manifold 971 either directs the flow to a drain 801 or to the CIP connector 960 through the macro-ingredient pumps 450, through the mixing-module 210, through the nozzle 220, through the clean-in-place cap 970, through a CIP recirculation line 1065, and back to the clean-in-place manifold 1020. Other pathways may be used herein. Some or all of the modules may be cleaned simultaneously.

Initially, the flush diverter 750 is in the flush position and the dispenser 100 is configured essentially as shown in FIG. 1. In order to clean and sanitize the dispenser 100, the first step is to flush the macro-ingredients 170. As is shown in FIG. 4, the macro-ingredient sources 180 are disconnected from the system by disconnecting the female fitting 430 from the male fitting 440. This is accomplished by actuating the CIP connector 960. The actuation of the CIP connector 960 also connects the CIP module 950 to the macro-ingredient pumps 450. The water source 130 is then turned on by the by the valve manifold 971 and the macro-ingredient pumps 450 are turned on. Water thus flows from the clean-in-place system 950, through the CIP connector 960, through the pumps 450 and the mixing module 210. The water is then flushed to the drain 800 via the flush diverter 750. After the macro-ingredients 190 have been purged, the water and the pumps 450 stop and the flush diverter 750 is then pivoted down into CIP position and the clean-in-place cap 970 is attached to the nozzle 220. A valve 1066 in the CIP recirculation line 1065 opens to allow a fluid communication path between the mixing-module 210 and the clean-in-place manifold 1020. The clean-in-place cap 970 captures the fluid that would exit the nozzle 220 and routs it via the carbonated water port 660 to the CIP recirculation line 1065 that goes to the clean-in-place manifold 1020. The flush diverter 750 then may be removed for cleaning. The dispenser 100 is now configured essentially as shown in FIG. 22.

The next step is to flush more thoroughly the remnants of the macro-ingredients 170 from the system by circulating hot water through the system. The water source 130 is then again turned on as are the macro-ingredient pumps 450. Air in the system then may be vented via the vents 1050 associated with the clean-in-place manifold 1020. The water source 130 then may be turned off and the drain 801 may be closed once the system is primed. The macro-ingredient pumps 450 are again turned on as is the heater 1040 so as to circulate hot water through the dispenser 100. Once the hot water has been circulated, the drain 801 may be opened and the water source 130 again turned on so as to circulate cold water through the dispenser 100 thus replacing the hot water containing remnants of the macro-ingredients 170 with fresh cold water.

In a similar manner, the cleaning chemicals 980 may be introduced into the dispenser 100 and circulated, heated, and replaced with cold water. The sanitizing chemicals 1000 likewise may be introduced, circulated, heated, and replaced with cold water. The clean-in-place cap 970 may be removed and the macro-ingredient sources 180 then may be attached to the system by deactuating the CIP connector 960. The deactuation of the CIP connector 960 also disconnects the CIP module 950 from the macro-ingredient pumps 450. The valve 1066 in the CIP recirculation line 1065 closes so as to discontinue the fluid communication between the mixing-module 210 and the clean-in-place manifold 1020. The flush diverter 750 then may be replaced and pivoted into the flush/dispense position. The dispenser 100 is again configured essentially as shown in FIG. 1. The beverage lines then may be primed with ingredient and dispensing may begin again. Other types of cleaning techniques may be used herein.

The interval between cleaning and sanitizing cycles may be different depending upon the nature of the ingredients used. The cleaning techniques described herein therefore may only need to be performed in some of the beverage lines as opposed to all.

It should be apparent that the foregoing relates only to the preferred embodiments of the present application and that numerous changes and modifications may be made herein by one of ordinary skill in the art without departing from the general spirit and scope of the invention as defined by the following claims and the equivalents thereof.

We claim:

1. A flush system for a dispenser nozzle, comprising:

a flush diverter;

the flush diverter comprising a dispense path aperture and a dispense position with a dispense path under the dispensing nozzle to dispense a beverage and a spaced apart flush position with a flush path to dispense a flushing fluid; and a carrier;

wherein the flush diverter moves within the carrier between the dispense position under the dispensing nozzle and the spaced apart flush position.

2. The flush system of claim 1, wherein the flush diverter comprises a drain pan and wherein the drain pan is in communication with a drain.

3. The flush system of claim 1, wherein the dispense path aperture comprises angled edges.

4. The flush system of claim 1, wherein the carrier comprises a carrier aperture therein.

5. The flush system of claim 1, wherein the flush diverter comprises a divider between the dispense path and the flush path.

6. The flush system of claim 1, further comprising a motor in communication with the flush diverter.

7. The flush system of claim 1, wherein the carrier comprises a hinge to rotate thereabout.

8. A method for operating a flush diverter about a dispenser nozzle, comprising:

maneuvering the flush diverter to a dispense position under the dispensing nozzle;

flowing a first fluid through the dispenser nozzle and through a dispense path aperture of the flush diverter;

moving the flush diverter to a flush position spaced apart from the dispense position; and flowing a second fluid through a flush path within the flush diverter to a drain.

9. The method of claim 8, further comprising moving the flush diverter to a clean-in-place position.

10. The method of claim 9, wherein moving the flush diverter to a clean-in -place position comprises removing the flush diverter.

11. The method of claim 9, wherein moving the flush diverter to a clean-in-place position comprises moving the flush diverter pivotably.

12. The method of claim 8, wherein moving the flush diverter to a dispense position comprises moving the flush diverter horizontally.

* * * * *